299-13
1/23/79 XR SR 4,135,450

United States Patent [19]

Lang

[11] 4,135,450

[45] Jan. 23, 1979

[54] METHOD OF UNDERGROUND MINING

[75] Inventor: Leslie C. Lang, Beaconsfield, Canada

[73] Assignee: Canadian Industries Limited, Montreal, Canada

[21] Appl. No.: 807,881

[22] Filed: Jun. 20, 1977

Related U.S. Application Data

[63] Continuation-in-part of Ser. No. 698,056, Jun. 21, 1976, abandoned.

[30] Foreign Application Priority Data

Jul. 11, 1975 [CA] Canada ..... 231434

[51] Int. Cl.[2] ..... F42B 3/00

[52] U.S. Cl. ..... 102/23; 299/13

[58] Field of Search ..... 102/22-24; 299/13

[56] References Cited

U.S. PATENT DOCUMENTS

| | | | |
|---|---|---|---|
| 2,312,752 | 3/1943 | Cook | 102/24 R |
| 2,387,701 | 10/1945 | Dove, Jr. | 102/22 |
| 3,537,753 | 11/1970 | Arendt | 299/13 X |
| 3,735,704 | 5/1973 | Livingston | 102/23 |
| 3,760,728 | 9/1973 | McKee | 102/24 |

*Primary Examiner*—Verlin R. Pendegrass
*Attorney, Agent, or Firm*—Donald G. Ballantyne

[57] ABSTRACT

A novel method of excavating underground chambers in strong rock is provided which is particularly suitable for use in stope and pillar mining operations. The method takes advantage of blasting techniques and specifically the use of large diameter spherical explosive charges by locating a spherical charge in a cavity provided in the ceiling or roof of an underground chamber. Upon detonation of the charge, an optimum volume of cavity is produced in the chamber ceiling from which well fragmented ore rock is displayed by gravity to the floor of the chamber from where it is easily removed.

3 Claims, 2 Drawing Figures

METHOD OF UNDERGROUND MINING

Figure 1:
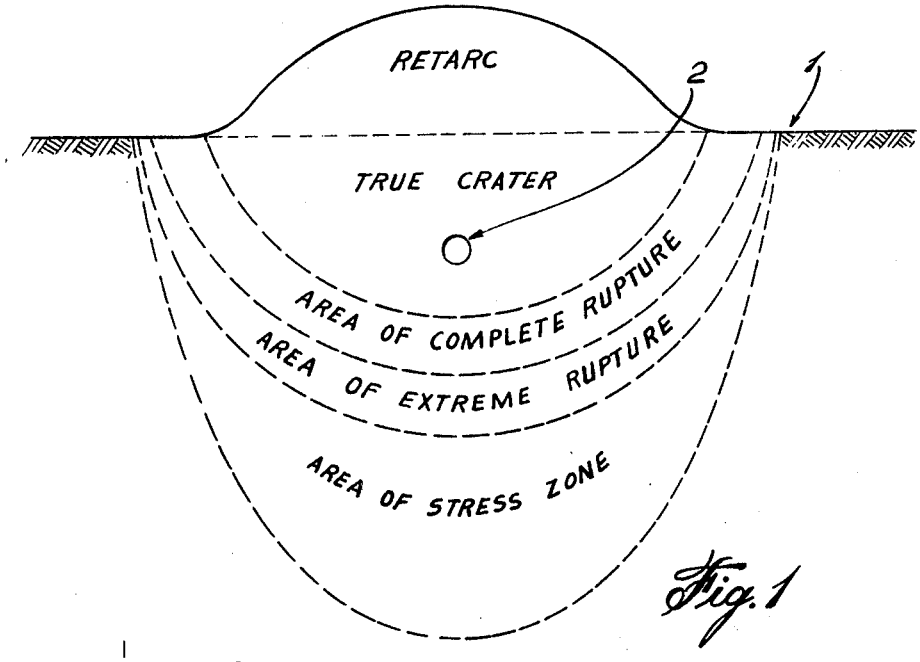

This application is a continuation-in-part application of U.S. application Ser. No. 698,056 filed on June 21, 1976, and now abandoned.

This invention relates to the blasting of rock bodies and more particularly to the application of explosive techniques to the underground mining of strong rock.

In the conventional method of recovering strong rock ore bodies in underground mines, it is the general practice to excavate the ore by blasting successive sections of the ore body and to remove the blasted, fragmented material from the mine site for further processing. As the ore is removed, underground rooms or chambers are created which are later backfilled with sand or waste rock and cement to give stability to the geologic formation. Pillars of ore or rock are also left in the chambers for structural support which pillars are subsequently removed and the ore recovered as backfilling progresses. This method of mining is commonly called "room and pillar" or "stope and pillar" mining. By strong rock is meant a rock substance having a uniaxial compression strength of at least 10,000 psi. Some strong rock may have a uniaxial compression strength of 70,000 psi or more.

The employment of this conventional mining method necessitates the repetitive drilling of large numbers of small diameter boreholes in patterned groups in the face of the ore body, the loading of explosives charges into the holes and subsequent detonation of the charges to dislodge and fragment the ore and rock. The resultant broken ore, sometimes of poor fragmentation, is then removed and the drilling and blasting operations repeated. Since drilling and borehole loading is more simply carried out in a horizontal plane, the ore body fragmented by the explosives does not always fall away cleanly from the vertical working face and must be removed by mechanical methods. Additionally, the patterned drilling and the explosive charging of large numbers of small diameter boreholes is time consuming and expensive especially where the working face is some height above the floor of the chamber. Furthermore, to provide access to all parts of the ore body, it is often necessary to construct raises and slots and the like, much of which construction is poorly productive in ore.

Another common mining system employes a caving technique. Caving finds particular application in friable rock of low uniaxial compressive strength where advantage is taken of the inherent weakness of the rock and of the force of gravity to effect fragmentation. In caving, a block of ore or rock material is undercut and the natural support for the ore is removed thus allowing the ore block to fall into the void of the undercut. Such caving techniques are suitable for use only in soft, unstable, friable ores where the deposits of recoverable material are large (such as oil shale) and where the ore body is relatively uniform throughout and is of regular shapes or has defined boundaries. Where natural arches are encountered in such soft ore, these must be removed by drilling small diameter boreholes along the perimeters of the block to be removed and detonate small explosive charges in the boreholes. This collapses the arch and induces further caving of the ore body. In caving, little if any explosive energy is directed to fragmentation of the ore body. Rather, fragmentation occurs with the collapse of the ore material into the void below. A typical caving mining method for use in the mining of oil shale is disclosed, for example, by Arendt in U.S. Pat. No. 3,537,753.

It has now been found that large savings in time and labor and consequent reduced costs can be achieved in the removal of underground strong rock ore bodies in underground excavation by utilizing explosives cratering techniques while employing high density explosive charges of spherical or near spherical configuration in large diameter cavities. The invention therefore provides for a method of mining or excavating wherein a rock mass is dislodged and fragmented by the force of an explosive charge from the roof of an underground chamber comprising the steps of:

(a) providing one or more large diameter cavities in said ore body;

(b) placing and stemming a large diameter spherical or spherically acting explosive charge in each of said cavities at a depth so as to achieve an optimum cratering effect upon the detonation of said explosive charges;

(c) detonating each of said explosive charges to produce an inverted crater in said ore body by breaking the strong rock by the force at the expression; and (d) removing from said chamber the fragmented ore dislodged from said crater. In the context of the method of this invention, by "large diameter cavities" is meant a cavity having a diameter in excess of 12.7 cm which may be provided by several conventional methods such as boring, etc. Similarly, by "large diameter spherical or spherically acting charges" is meant an explosive charge which occupies substantially all of the cross section or diameter of a large diameter cavity, and has a diameter-to-length ratio not exceeding 1:6. Preferably the explosive composition employed in the large diameter charge will have a density of about 1.5 to provide adequate shattering and fragmentation of the blasted strong rock or ore.

The principles of optimum explosive cratering are well known and have been widely documented. (See, for example, U.S. Pat. No. 3,735,704, issued to C. W. Livingston on May 29, 1973). Briefly summarized, the maximum or optimum degree of cratering or fracturing of material by an explosive can be achieved by locating and detonating an explosive charge in a borehole below the surface of the material at a preferred or optimum position determined from a knowledge of the properties of both the explosive and the material to be ruptured. The method most practially employed to determine the optimum position of the explosive charge and for predicting crater size and geometry is an empirical scaling from test craters made in the same or similar material.

The effect of the shape of the explosive charge in blasting is also well known. The basic geometry and the breakage process of, for example, a spherical and a cylindrical charge are quite different, and consequently so are the blasting results obtained. In the detonation of a cylindrical charge, nearly all of the energy produced by the pressure of generated gas is directed laterally, i.e. perpendicular to the cylindrical cavity or borehole axis, and only a small part of the energy is utilized at the two ends of the cylindrical explosive column. In the detonation of a spherical charge on the other hand, the energy produced by the expanding gases is directed radially outward from the center of the charge in all planes passing through its center, and in uniform, spherically diverging action.

It has been found that as long as the deviation from the true spherical charge shape (diameter = length) is not greater than a ratio of 1:6 diameter to length of the charge, the breakage mechanism and the blasting results are nearly the same as that achieved by using a true spherical charge. The energy distribution effect of charge shape (spherical vs. cylindrical) can be illustrated by the results of a cratering experiment. In a test, two charges of 4.5 kg. of slurry explosive were used in vertical boreholes in sandstone. One hole was 11.4 cm in diameter, the other only 6.7 cm, but both were drilled to the same depth of 1.2 m.

The results are summarized in the Table below.

TABLE

| | Crater No. 1 | Crater No. 2 |
|---|---|---|
| Hole diameter | 11.4 cm | 6.7 cm |
| Hole depth | 1.2 m | 1.2 m |
| Charge weight | 4.5 kg | 4.5 kg |
| Center of gravity of charge in hole | 1.07 m | 0.72 m |
| Vol. of crater produced | 2.30 $m^3$ | 1.09 $m^3$ |
| Radii of crater | 1.74 m | 1.46 m |
| Charge size L:D | 2.7:1 | 15:1 |

As can be seen from the Table, the difference in charge shape influenced the stress distribution. Consequently, the energy utilization and the behaviour of the sandstone reduced the crater volume blasted by the cylindrical charge in Crater No. 2 as compared with the substantially spherical or spherically acting charge in Crater No. 1.

Spherical charges in the past have been used for cratering only in an upward direction towards a horizontal free face and have found some application in surface and quarry blasting. Depending on the depth of burial of the charge, the result may be a crater which consists of three almost concentric zones. These zones have been defined as the apparent crater, the true crater, and the rupture zone. The rupture zone in turn may be divided into the zones of complete and extreme rupture. Within this rupture zone the material has been displaced slightly upward and outward and the rock has more fractures than exist in the natural or undisturbed state. The interface between the rupture zone and the undisturbed in situ material is hard to locate because the material of the rupture zone cannot be excavated in most cases. When a spherical charge is detonated at optimum depth as determined by tests blasts for the given rock and explosive combination, the result is a positive crater which is designated RETARC. When producing a RETARC, no venting of the detonation gases occur at the surface. The broken material lifts up to form a hemisphere, excellent fragmentation results, and a large volume of material is broken per unit weight of explosive used.

In the method of mining of this invention advantage is taken in underground operations of the results of a positive or RETARC crater by producing an inverted or up-side down crater in the roof or ceiling of the mining chamber and utilizing the force gravity to excavate the broken material within the crater. The use of the method actually propells the broken ore towards the floor of the chamber producing a well fragmented excavate which comes away cleanly from the ore body leaving little or no hang-up material behind. Furthermore, since several craters can be simultaneously blasted in slightly overlapping relationship with each other, the ore body can be taken down in a predetermined and accurate pattern without the need to provide auxiliary openings such as raises and slots or other preparatory work.

In a typical application of a preferred embodiment the mining method of this invention, a tunnel or undercut may be driven by conventional means from a mine shaft in a horizontal direction into an ore body thus creating a relatively low, long chamber under part of the ore body. A second tunnel or cut is driven parallel to and directly above (or below) the first tunnel thus creating two low profile, superimposed chambers on an upper and lower face of the ore body. These low chambers may be separated from each other a distance of 30 meters or more. To provide the cavities for the placement of the large diameter explosive charges of spherical shape, the most common method may be used. For example, one or more boreholes are drilled through the ore body from the upper chamber to the lower chamber. For this drilling, advantage can be taken of the recently developed "in the hole" drilling equipment which is capable of drilling holes up to 16.5 cm in diameter in underground locations. Alternatively, cavities may be made upward or at an incline from the lower chamber but this is less convenient than downward drilling. After removal of the drill, the bottom of the borehole is plugged, then spherically-acting explosive charges are placed in one or each borehole at a position close to the lower chamber face of the ore body. The exact or optimum positioning of the charge is determined on the basis of small charge trials with the same explosive detonated at various depths of burial in similar ore. After the charge is positioned in one or more of the cavities or boreholes, stemming material is placed above the charge. Upon initiation of the explosive charge or charges, one or more craters are formed in the roof of the lower chamber and well fragmented material from the fracture zone of the crater as well as some material from the stress zone within the chimney above the fracture zone of the crater falls away and is deposited on the floor of the lower chamber from where it may be easily removed by mechanical equipment.

Figure 2:
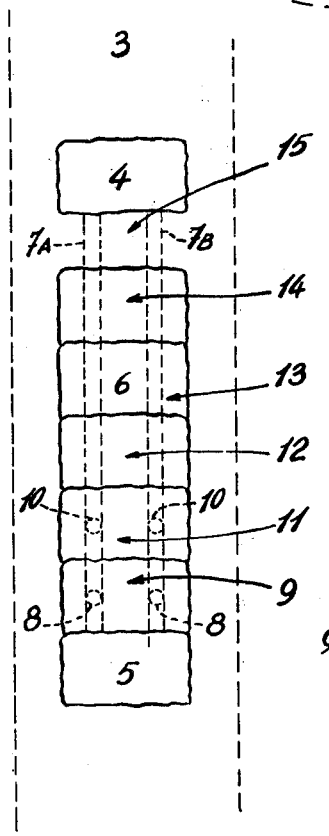

The method of the invention may be better understood by reference to the accompanying drawings wherein:

FIG. 1 shows in cross-section the various rupture or fracture zones in a RETARC crater blasted in an upward direction, and, FIG. 2 shows in cross-section a typical underground mine working showing the sections of ore body removed by the method of the invention.

Referring to FIG. 1, there is shown a face or surface of earth or rock 1 with a spherical explosive charge 2 in a position so as to achieve maximum rock fracture when detonated. After detonation of spherical charge 2, the fracture areas are shown by the various labels in the Figure. The positive crater (RETARC) and the true crater comprise completely fractured and well fragmented material which can be easily excavated. The area of complete rupture comprises well broken material in fragments larger than those in the true crater and somewhat more difficult to excavate. The area of extreme rupture comprises material which has been slightly displaced and which has more fractures than in the natural state. This material, held together by forces of gravity and friction, is difficult to excavate. The degree of fracture and disruption of the material in the stress zone depends on the rock properties and structural geology.

It will be seen that where a crater as shown in FIG. 1 is produced in a downward direction on the upper face or roof of a mine opening, all of the material of the RETARC and the true crater and the area of complete rupture will fall away. In addition, because the material within the extreme area of rupture is not adversely effected by friction and gravity, generally the whole of this body will also dislodged. Likewise, depending on rock type and geology, varying amounts of the material in the stress zone or chimney area will also be dislodged. Indeed, this dislodgement is aided by the destressing effect as the rock recovers from the impact of the detonation forces.

Referring to FIG. 2 there is shown a cross-section of a mine working having a shaft 3 from which lead upper horizontal tunnel or cut 4 and lower cut 5 on two sides of an orebody 6. A series of large diameter cavities or boreholes 7 are shown penetrating orebody 6 between cuts 4 and 5. For convenience only two boreholes 7A and 7B are shown in cross-section. A spherical explosive charge 8 is shown in optimum position to produce a RETARC crater in each of borehole 7A and 7B, above cut 5. The charges 8 are conveniently placed by lowering from cut 4 above. After being stemmed in place, the charges 8 are detonated and the ore area designated 9 is ruptured and falls to the floor of cut 5 from whence it is removed. Subsequently spherical charges 10 are positioned in boreholes 7A and 7B and are detonated to dislodge the ore area designated 11. Successive removal of ore areas 12, 13 and 14 are similarly undertaken in the same manner. A shelf of rock or ore 15 is left to provide a safe working surface over the chamber created by the removal of the ore body 6. The entire ore body 6 may likewise be removed in the manner described.

In an actual application of the method of the invention in an underground mine, a pillar of high grade metallic ore having a uniaxial strength of 35,000 psi (2450 kg/sq.cm) was conveniently and economically removed. The pillar was 50 meters long, 5½ meters wide and 20 meters high having a sand/cement backfill on both sides. After excavation of an undercut at the bottom of the pillar, the method herein described was employed to remove the pillar in horizontal slab sections of about 4–5 meters each. Excellent fragmentation of the ore material was achieved without disturbing the backfill which was fully exposed. Economies in labor, drilling time and explosive usage were achieved.

It will be seen that the excavation or mining method of the invention may be utilized to advantageously reduce or eliminate the uphole drilling, raise boring and slot blasting associated with conventional undergound mining methods. In addition, the advantages of improved ore fragmentation and virtual elimination of secondary blasting, the reduction in ore dilution from backfill and economies in labor, time and explosives may be realized. A further, important advantage is that the energy generated by the detonation of a spherical charge is not dissipated in the form of seismic vibrations, hence physical damage to the area surrounding the blast site is minimized or eliminated.

It has been determined that the novel mining method invention as hereinbefore described is not limited to use in the stope and pillar mining of strong rock ore bodies. The method is adaptable to the fragmenting and dislodgement of any strong mineral or rock material in the excavation of underground cavities or chambers of the kind useful, for example, as storage chambers for oil, water, waste, etc. fallout shelters, underground industrial or military installations, garages and the like. Conventionally, such underground chambers have been constructed by normal or usual mining procedures involving the drilling of a large number of patterned small-diameter boreholes in the face or ceiling of the rock chamber, loading explosives into the holes and detonating the charges to dislodge the rock. It has now been found that economies in time, labor and cost of explosives can be achieved in the construction of such underground chambers by employing explosive cratering techniques as referred to hereinbefore.

In a typical application of the method of the invention in, for example, the excavation of sub-surface rock for the construction of an oil storage reservoir, an initial shaft or tunnel is constructed by conventional methods to reach a selected position below the surface of the earth. At the terminal of the shaft an enlarged chamber may be excavated again employing conventional mining methods. When the shaft terminal chamber is large enough to accommodate drilling equipment capable of drilling large diameter cavities, one or more cavities are drilled or hammered into the roof of the chamber. Alternatively, if the chamber is not too far below the earth's surface, large diameter boreholes may be drilled downward from the surface to intersect the chamber. A spherical explosive charge is placed in each cavity or borehole in an optimum position to produce upon detonation a maximum crater in the roof of the chamber. The fractured rock which falls to the floor of the chamber is removed and the drilling and blasting operation repeated in a like manner until a chamber of required size is excavated.

What we claim is:

1. A method of excavating an underground chamber in a body of strong rock or mineral having a uniaxial compression strength of at least 10,000 psi wherein the rock or mineral is fragmented by an explosive force and dislodged from the roof of the chamber, comprising the steps of:

(a) providing a plurality of spaced apart cylindrical cavities in a zone in the roof of an underground chamber, said cavities having a diameter in excess of 12.7 cm.;

(b) locating an explosive charge in each cavity so that the explosive occupies substantially all of the cross-section of the said cavity, said explosive charge having a diameter-to-length ratio not exceeding 1:6 and said explosive charge being stemmed in said cavity in such a position to produce an optimum cratering effect upon detonation, said cavities being arranged such that adjacent craters to be produced upon detonation overlap throughout said zone;

(c) detonating each of said explosive charges to produce inverted or up-side down overlapping craters throughout said zone whereby all the rock or mineral in said zone is fragmented and thereafter falls by gravity to the floor of said chamber, leaving the rock or mineral not fragmented by the detonations in place in the roof; and (d) removing from said chamber the fragmented rock or mineral dislodged from said craters and deposited on the floor of said chamber.

2. A method as claimed in claim 1 wherein the said explosive charge has a density of 1.5 gr/cc.

3. A method as claimed in claim 1 wherein the said cylindrical cavities comprise boreholes drilled downward from the earth's surface or from an adjacent upper second chamber into strong rock to intersect said chamber roof.

* * * * *